US010260366B2

(12) United States Patent
Yamaguchi et al.

(10) Patent No.: US 10,260,366 B2
(45) Date of Patent: Apr. 16, 2019

(54) SEALING DEVICE AND TURBO MACHINE

(71) Applicant: Mitsubishi Hitachi Power Systems, Ltd., Yokohama, Kanagawa (JP)

(72) Inventors: Kazuyuki Yamaguchi, Tokyo (JP); Akira Endo, Tokyo (JP); Kenichi Murata, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 134 days.

(21) Appl. No.: 14/934,575

(22) Filed: Nov. 6, 2015

(65) Prior Publication Data

US 2016/0130965 A1 May 12, 2016

(30) Foreign Application Priority Data

Nov. 7, 2014 (JP) ..... 2014-227257

(51) Int. Cl.
*F01D 1/04* (2006.01)
*F01D 11/00* (2006.01)
(Continued)

(52) U.S. Cl.
CPC ..... *F01D 11/006* (2013.01); *F01D 1/04* (2013.01); *F01D 11/005* (2013.01); *F01D 11/02* (2013.01); *F01D 11/08* (2013.01)

(58) Field of Classification Search
CPC ..... F01D 11/00; F01D 11/001; F01D 11/003; F01D 11/02; F01D 11/08; F01D 11/12; F01D 11/122; F01D 11/127
(Continued)

(56) References Cited

U.S. PATENT DOCUMENTS 3,251,601 A 5/1966 Harvey
5,088,889 A * 2/1992 Wolff ..... F01D 11/02 277/423
(Continued)

FOREIGN PATENT DOCUMENTS

EP 0 911 491 A1 4/1999
GB 2492546 A 1/2013
(Continued)

OTHER PUBLICATIONS

Extended European Search Report issued in counterpart European Application No. 15193268.8 dated Mar. 30, 2016 (6 pages).
(Continued)

*Primary Examiner* — Richard A Edgar
(74) *Attorney, Agent, or Firm* — Crowell & Moring LLP

(57) ABSTRACT

The turbo machine includes a rotor 1 with a rotating shaft 3, a stator 2 enclosing the rotor 1 and a sealing device 20 installed in a clearance passage defined between the rotor 1 and the stator 2, the sealing device 20 controlling a leakage flow from the clearance passage B. The sealing device 20 includes a plurality of sealing fins 24 disposed on at least one of the rotor 1 and the stator 2, and arranged in an axial direction of the rotor 1. The sealing device 20 further includes at least one deceleration controlling member 25 provided on the rotational side. The deceleration controlling member 25 projects toward a chamber 30 defined between the sealing fins 24 and is configured to control a reduction in the velocity of the leakage flow B in the chamber 30 in the rotational direction of the rotor 1.

10 Claims, 5 Drawing Sheets

(51) Int. Cl.
*F01D 11/02* (2006.01)
*F01D 11/08* (2006.01)

(58) Field of Classification Search
USPC ..... 415/173.1, 173.5, 173.6, 173.7, 174.5
See application file for complete search history.

(56) References Cited

U.S. PATENT DOCUMENTS 5,540,447 A * 7/1996 Shultz ..... F01D 25/04 277/303
6,962,482 B2 * 11/2005 Tanaka ..... F01D 5/225 277/414
7,971,882 B1 * 7/2011 Liang ..... F01D 11/02 277/418
8,128,351 B2 * 3/2012 Narita ..... F01D 11/001 415/173.1
2009/0142187 A1 6/2009 Narita et al.
2011/0236189 A1 9/2011 Ono et al.
2012/0027573 A1 * 2/2012 Ali ..... F01D 5/225 415/173.1
2014/0314579 A1 10/2014 Kuwamura et al.
2015/0369075 A1 12/2015 Nishijima et al.

FOREIGN PATENT DOCUMENTS

JP 2010-77882 A 4/2010
JP 2012-7594 A 1/2012
JP 2013-124554 A 6/2013
JP 2014-181586 A 9/2014
WO WO 2014/091599 A1 1/2017

OTHER PUBLICATIONS

Japanese-language Office Action issued in counterpart Japanese Application No. 2014-227257 dated Mar. 27, 2018 (nine (9) pages).

* cited by examiner

SEALING DEVICE AND TURBO MACHINE

BACKGROUND OF THE INVENTION

1. Field of the Invention

The present invention relates to sealing devices and turbo machines, and more specifically to a sealing device that controls a leakage flow in a clearance passage defined between the rotor and stator of a turbo machine and to a turbo machine with the sealing device.

2. Description of the Related Art

In turbo machines such as steam turbines, gas turbines, and centrifugal compressors, to prevent working fluid from leaking along a rotating shaft (a rotor) from a casing (a stator) enclosing the rotating shaft, a labyrinth seal is often provided in a clearance passage between the rotating shaft and the casing. The labyrinth seal typically has a plurality of sealing fins in the axial direction of the rotating shaft. The labyrinth seal has chambers defined between the sealing fins along the outer circumferential surface of the rotating shaft. The chambers cause a pressure drop in the leakage flow of the working fluid flowing down in the labyrinth seal. This pressure drop controls a leakage quantity.

In the turbo machine with such a labyrinth seal, if a leakage flow (a swirl flow) having a velocity component in the circumferential direction of the rotating shaft flows into the labyrinth seal, vibrations of the rotating shaft tend to increase. A sealing device is proposed as a technology for suppressing such unstable vibrations of the rotating shaft in JP-2012-7594-A. The sealing device incorporates a stepped portion on the outer circumference of an impeller (a rotor), the stepped portion being reduced in diameter from the higher pressure side toward the lower pressure side. In addition, the sealing device incorporates a plate-shaped swirl breaker on the lower pressure side of the stepped portion of the impeller (the rotor) and on the higher pressure side of the labyrinth seal, the swirl breaker extending radially inwardly from the casing (the stator) and facing the rotational direction of the rotor. In this way, the sealing device prevents the swirl flow from going into the labyrinth seal.

SUMMARY OF THE INVENTION

The sealing device described in JP-2012-7594-A is provided with the plate-shaped swirl breaker at the inlet side of the labyrinth seal, the swirl breaker facing the rotational direction. The swirl breaker consequently occupies a certain width in the axial direction of the rotor at the inlet of the labyrinth seal. This may result in the smaller number of sealing fins that can be arranged in the axial direction of the rotor. In this situation, the function of controlling the leakage quantity, an original function of the labyrinth seal, will deteriorate.

With respect to the unstable vibrations of the rotating shaft of the turbo machine, the following is found. A leakage flow in a general labyrinth seal is such that its velocity in the rotational direction of the rotor gradually reduces in the axial direction of the rotor due to, for example, friction with the stator when the leakage flow passes through the inside of the seal. In this case, a pressure gradient toward the decelerating direction of the leakage flow occurs, particularly the pressure increase according to the amount of deceleration. This pressure gradient encourages the unstable vibrations of the rotating shaft. The magnitude of the pressure gradient depends on the amount of deceleration in the rotational-direction velocity of the leakage flow, and thus the unstable vibrations of the rotating shaft will correspond to the amount of deceleration in the rotational-direction velocity of the leakage flow.

The present invention has been made to solve the above problems and aims to provide a sealing device and a turbo machine with the sealing device, the sealing device suppressing unstable vibrations of a rotating shaft of a turbo machine without reducing the number of sealing fins.

To solve the above problems, the present invention provides several means for solving the above problems. A turbo machine according to one aspect of the present invention includes: a rotor having a rotating shaft; a stator enclosing the rotor; and a sealing device installed in a clearance passage defined between the rotor and the stator, the sealing device controlling a leakage flow from the clearance passage. The sealing device includes a plurality of sealing fins disposed on at least one of the rotor and the stator, and arranged in an axial direction of the rotor. The sealing device further includes at least one deceleration controlling member provided on a rotational side. The deceleration controlling member projects toward a chamber defined between the sealing fins and is configured to control a reduction in the velocity of the leakage flow in the chamber in a rotational direction of the rotor.

According to one aspect of the present invention, the deceleration controlling member disposed between the sealing fins rotates along with the rotation of the rotor. The rotation of the deceleration controlling member consequently controls the reduction in the rotational-direction velocity of the leakage flow. Thus, the unstable vibrations of the rotating shaft of the turbo machine can be suppressed without reducing the number of the sealing fins.

Other subjects, configurations, and advantages will be apparent in the descriptions of the following embodiments.

DESCRIPTION OF THE PREFERRED EMBODIMENTS

Embodiments of a sealing device and a turbo machine of the present invention will hereinafter be described with reference to the drawings. A description is here given taking as an example a case where the turbo machine of the present invention is applied to a steam turbine. However, the turbo machine of the present invention can be applied to, for example, a gas turbine, a centrifugal compressor, or other devices.

First Embodiment

A configuration of a steam turbine to which a turbo machine according to a first embodiment of the present invention is applied is first described with reference to FIG. 1.

Figure 1:
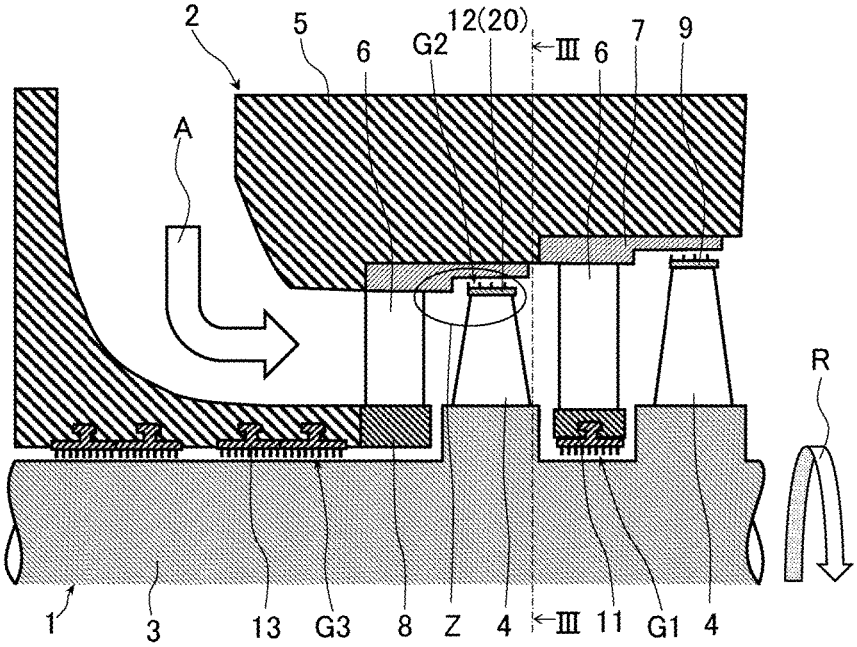
FIG. 1 is a longitudinal cross-sectional view illustrating chief elements of a steam turbine to which a sealing device and a turbo machine according to a first embodiment of the present invention is applied.

FIG. 1 is a longitudinal cross-sectional view of chief elements of a steam turbine to which a sealing device and a turbo machine according to a first embodiment of the present invention is applied. In FIG. 1, arrow A denotes the flow of main steam, and arrow R denotes the rotational direction of a rotating shaft 3.

Referring to FIG. 1, a steam turbine includes a rotor 1 and a stator 2 enclosing and holding the rotor 1. The rotor 1 includes a rotating shaft 3 and a plurality of rotor blades 4 mounted circumferentially on the outer circumferential surface of the rotating shaft 3 in a removable manner. The rotating shaft 3 is connected to, for example, a generator (not shown). A segment of a shroud 9 is provided on the tip of each of the rotor blades 4. The shroud 9 is formed in an annular shape by coupling adjacent segments of the shroud 9. The stator 2 includes a casing 5 and a plurality of nozzles 6. The casing 5 encloses and holds the rotating shaft 3 and defines a passage for main steam serving as a working fluid. The nozzles 6 are secured to the casing 5 in a circumferential direction of the casing 5 so as to face the rotor blades 4 at the upstream of the flow A of the main steam. An annular nozzle diaphragm outer ring 7 is secured to the inner circumferential side of the casing 5. The nozzles 6 are held by the casing 5 by securing the outer tips of the nozzles 6 to the nozzle diaphragm outer ring 7. An annular nozzle diaphragm inner ring 8 is provided at the inner circumference tips of the nozzles 6. The nozzle diaphragm inner ring 8 forms part of the inner circumferential wall of the passage for main steam. Also the nozzle diaphragm outer ring 7 and the nozzle diaphragm inner ring 8 are part of the configuration of the stator 2. In the steam turbine, the nozzles 6 and the rotor blades 4 configure a stage, and the steam turbine has a plurality of the stages (two stages in FIG. 1) in the axial direction of the rotating shaft 3.

The main steam, which is a working fluid, is accelerated when passing through the nozzles 6 and is sent to the rotor blades 4. The velocity energy of the main steam is then converted into rotational kinetic energy for the rotor blades 4 and the rotating shaft 3. The power output of the steam turbine is taken out as electric energy by the generator (not shown) connected to the rotating shaft 3.

Clearance passages are provided between the rotor 1 and the stator 2 so as not to obstruct the rotation of the rotor 1. For example, such clearance passages include a clearance passage G1 between the rotating shaft 3 and the nozzle diaphragm inner ring 8, a clearance passage G2 between the rotor blades 4 and the casing 5 (the nozzle diaphragm outer ring 7), and a clearance passage G3 between the rotating shaft 3 and the casing 5. If the flow A of the main steam partially leaks out from the higher pressure side toward lower pressure side of the clearance passages G1, G2 and G3, such leakage contributes to the lower efficiency of the steam turbine. Thus, a diaphragm packing 11, tip fins 12, and shaft packings 13, which control the leakage flow of the main steam, are installed in the clearance passages G1, G2, and G3, respectively.

The detailed configuration of the sealing device according to the first embodiment of the present invention will now be described with reference to FIGS. 2 and 3. An example is here described in which the sealing device of the present embodiment is used as a tip fin to prevent the leakage of steam from the clearance passage G2 between the rotor blades 4 and the casing 5.

Figure 2:
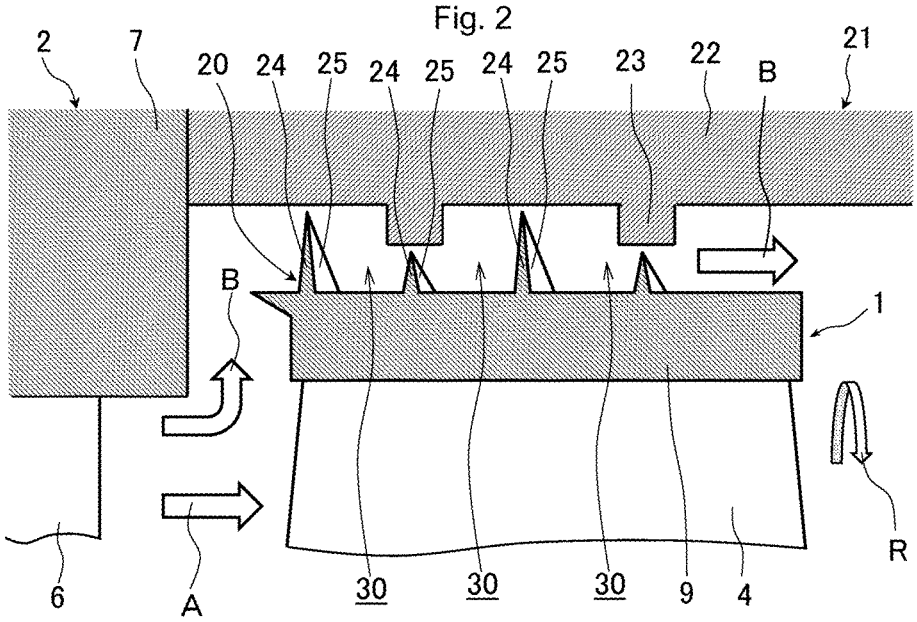
FIG. 2 is an enlarged longitudinal cross-sectional view of part indicated by symbol Z in FIG. 1, illustrating the sealing device according to the first embodiment of the present invention and parts near the sealing device.
Figure 3:
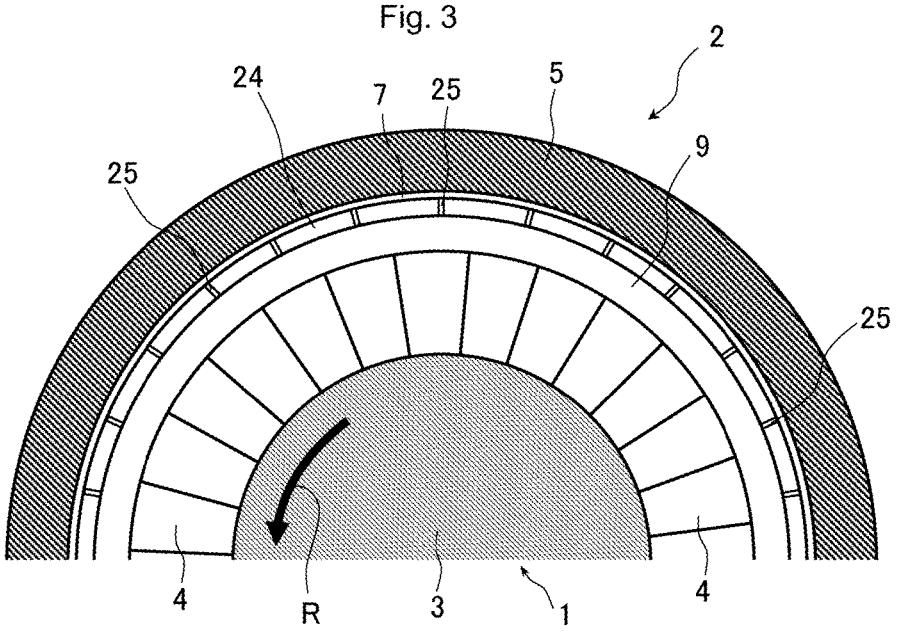
FIG. 3 is a schematic transverse cross-sectional view as seen from arrows III-III in FIG. 1, illustrating the steam turbine to which the sealing device and turbo machine according to the first embodiment of the present invention is applied.

FIG. 2 is an enlarged longitudinal cross-sectional view of part indicated by symbol Z in FIG. 1, illustrating the sealing device according to the first embodiment of the present invention and parts near the sealing device. FIG. 3 is a schematic transverse cross-sectional view as seen from arrows III-III in FIG. 1, illustrating the steam turbine to which the sealing device and turbo machine according to the first embodiment of the present invention is applied. In FIG. 2, arrow A denotes the flow of main steam, arrow B denotes a leakage flow, and arrow R denotes the rotational direction of the rotating shaft. In FIG. 3, arrow R denotes the rotational direction of the rotating shaft. In FIGS. 2 and 3, the same elements as used in FIG. 1 are each assigned the same reference number and detailed description of these elements is therefore omitted herein.

Referring to FIG. 2, the sealing device 20 has a sealing ring 21 mounted to a portion of the nozzle diaphragm outer ring 7, the portion being located external of the shroud 9. The sealing ring 21 is of a circular shape by assembling a plurality of arc-shaped segments and is disposed to face the outer circumferential surface of the shroud 9. The sealing ring 21 incorporates a roughly circular main body 22 attached to the nozzle diaphragm outer ring 7 and protrusions 23 which project from the inner circumferential surface of the main body 22 toward the radially inward side of the rotating shaft 3. The protrusions 23 extend in the circumferential direction of the main body 22 so as to form a circular shape. In addition, the protrusions 23 are provided in a plurality of stages (two stages in FIG. 2) in the axial direction of the main body 22.

In addition, the sealing device 20 has sealing fins 24 that project radially outwardly of the rotating shaft 3 from the outer circumferential surface of the shroud 9. The sealing fins 24 circumferentially extend on the outer circumferential surface of the shroud 9 and are of an annular shape. The sealing fins 24 are provided in a plurality of stages (four stages in FIG. 2) in the axial direction of the shroud 9. Among the plurality of stages of sealing fins 24, some of the stages are provided to face protrusions 23. On the other hand, the sealing fin 24 of a first stage located on the furthest upstream of the leakage flow B of the steam do not face any of the protrusions 23 but face the main body 22. The sealing fins 24 change in length in accordance with the protrusions 23 of the sealing ring 21 so that the clearances between the tips of the sealing fins 24 and the sealing ring 21 are equal in length. The sealing fins 24 are produced through, for example, lathing. Circular chambers 30 are defined between the stages of sealing fins 24 in the circumferential direction of the rotating shaft 3.

The sealing device 20 further has ribs 25, which are provided on the sealing fins 24 and the shroud 9 so as to project in the corresponding chambers 30 between the sealing fins 24. For example, the ribs 25 are disposed to project from each of the plurality of stages of sealing fins 24 toward the downstream of the leakage flow in the axial direction of the rotating shaft 3. In addition, each of the ribs 25 extends in the height direction of the sealing fin 24 and is formed in a triangular shape as viewed in the circumferential direction of the rotating shaft 3. Further, a plurality of the ribs 25 are arranged at intervals in the circumferential direction of the sealing fins 24 as shown in FIG. 3. The ribs 25 are individually attached by, for example, additionally processing the shroud 9. The thus configured ribs 25 function as deceleration controlling members, which rotate along with the rotation of the shroud 9 and the sealing fins 24 and consequently control a reduction in the rotational-direction velocity of the leakage flow B in the chambers 30, as described below.

Figure 4:
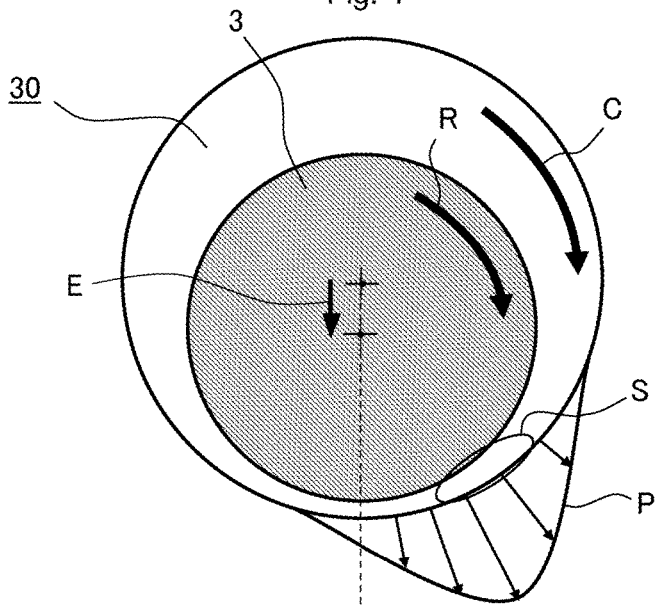
FIG. 4 is an explanatory diagram illustrating a pressure distribution in a chamber of a conventional labyrinth seal when a rotating shaft is eccentric.

A description is next given of the configuration and problems of a conventional labyrinth seal as a comparative example of the sealing device according to the first embodiment of the present invention with reference to FIG. 4.

FIG. 4 is an explanatory diagram of a pressure distribution when a rotating shaft is eccentric in the chamber of the conventional labyrinth seal. In FIG. 4, arrow C denotes a flow in a rotational direction, arrow E denotes the eccentric direction of the rotating shaft 3, and arrow R denotes the rotational direction of the rotating shaft 3. In FIG. 4, the same elements as used in FIGS. 1 to 3 are each assigned the same reference number and detailed description of these elements is therefore omitted herein.

Referring to FIG. 4, the conventional labyrinth seal has a plurality of circular sealing fins (omitted in FIG. 4) that project radially outwardly from the outer circumferential surface of the rotating shaft 3 and are arranged in the axial direction of the rotating shaft 3, for example. Circular chambers 30 are defined between these sealing fins along the outer circumference of the rotating shaft 3. Such a labyrinth seal has problems as below.

A leakage flow in the labyrinth seal swirls in the rotational direction R of the rotating shaft 3 by co-rotation resulting from the rotation of the rotating shaft 3. This swirling leads to a rotational-direction flow C. In this situation, if the rotating shaft 3 becomes eccentric (vibration displacement) in some direction, e.g., in the direction of arrow E, a narrowed portion may be formed in the direction of arrow E (an eccentric direction) in the chamber 30. The rotational-direction flow C is held back (is decelerated) at an upstream area S in the eccentric direction E of the rotating shaft 3 in the chamber 30. Consequently, a high pressure portion occurs in this area S. In the chamber 30 as in FIG. 4, an asymmetric pressure distribution P (a non-uniform pressure distribution P in the circumferential direction of the rotating shaft 3) occurs in which the upstream of the rotational-direction flow C with respect to the eccentric direction E of the rotating shaft 3 has a higher pressure. Because of this asymmetric pressure distribution P, a fluid force occurs in a direction perpendicular to the eccentric direction E of the rotating shaft 3. The fluid force acts on the rotating shaft 3 so as to push the rotating shaft 3 in the rotational direction R. The repetition of such situations leads to the whirling of the rotating shaft 3, thereby resulting in the unstable vibrations of the rotating shaft 3.

It is found that the above-described fluid force whirling the rotating shaft 3 in the rotational direction occurs also due to the deceleration of the rotational-direction flow C occurring when the leakage flow passes through the labyrinth seal. When passing through the inside of the labyrinth seal, the rotational-direction flow C of the leakage flow is decelerated in the axial direction of the rotating shaft due to the friction with the stator or other causes. In the labyrinth seal a pressure gradient occurs in which the pressure increases in accordance with the deceleration amount of the rotational-direction flow C toward the decelerating direction of the rotational-direction flow C. This pressure gradient also contributes to the increased fluid force that leads to the whirling of the rotating shaft 3. The magnitude of the pressure gradient depends on the deceleration amount of the rotational-direction flow C. The magnitude of the fluid force caused by the pressure gradient thus also corresponds to the deceleration amount of the rotational-direction flow C. That is to say, as the deceleration amount of the rotational-direction flow C is larger, the fluid force increases more, enlarging the unstable vibrations of the rotating shaft 3.

The causes of the unstable vibrations of the rotating shaft 3 resulting from the inflow of the leakage flow into the labyrinth seal include the above-described two causes. A seal like the tip fin 12 (see FIG. 1) having the small number of sealing fins is proved to have the following characteristics. The fluid force resulting from the pressure gradient depending on the deceleration amount of the rotational-direction flow C has a greater effect on the unstable vibrations of the rotating shaft 3 than the fluid force resulting from the pressure distribution P asymmetric with respect to the eccentric direction E of the rotating shaft 3.

The function and effect of the sealing device according to the first embodiment of the present invention will now be described in comparison with the conventional labyrinth seal with reference to FIGS. 2 and 5.

Figure 5:
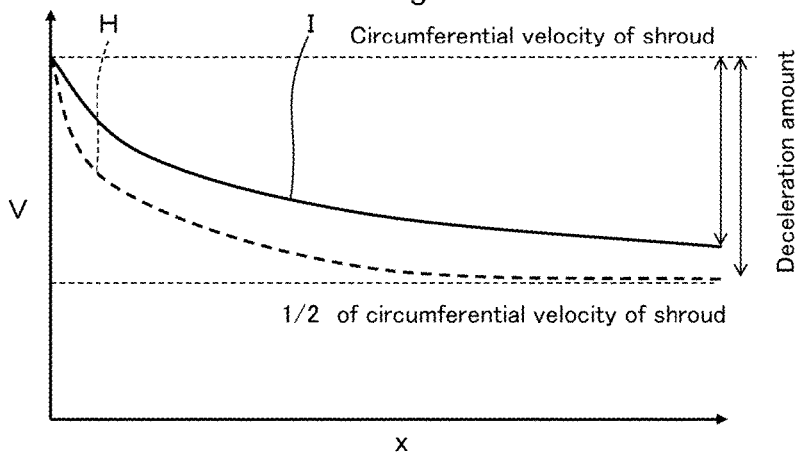
FIG. 5 is a characteristic diagram illustrating the relation of the rotational-direction velocity of the leakage flow to the axial position of a leakage flow in the sealing device according to the first embodiment of the present invention and in the conventional labyrinth seal.

FIG. 5 is a characteristic diagram illustrating the relation of the rotational-direction velocity of the leakage flow to the axial position of a leakage flow in the sealing device according to the first embodiment of the present invention and in the conventional labyrinth seal. In FIG. 5, the vertical axis V represents the rotational-direction velocity of the leakage flow (the velocity of the rotational-direction flow of the leakage flow). The horizontal axis x represents the axial positions of the sealing fins located from the furthest upstream to the furthest downstream of the leakage flow. In the diagram, a broken line H represents a characteristic curve of the conventional labyrinth seal and a solid line I represents a characteristic curve of the sealing device of the present embodiment.

The leakage flow B flowing into the sealing device 20 from the main steam flow A in FIG. 2 has the rotational-direction velocity approximately equal to the circumferential velocity of the shroud 9. The rotational-direction velocity (the velocity of the rotational-direction flow) of the leakage flow B flowing into the sealing device 20, then, gradually decreases toward the downstream of the leakage flow in the axial direction of the rotating shaft 3 due to the friction with the inner circumferential surface of the sealing ring 21 or other causes. At this time, in the sealing device 20 a pressure gradient occurs in which the pressure increases in accordance with the deceleration amount of the rotational-direction velocity toward the deceleration direction of the rotational-direction velocity of the leakage flow B. This pressure gradient increases the fluid force that leads to the whirling of the rotating shaft 3. The fluid force becomes larger in accordance with the deceleration amount of the rotational-direction velocity of the leakage flow B.

For the conventional labyrinth seal, the rotational-direction velocity V of the leakage flow decreases in such a manner as to gradually come close from a value approximately equal to the circumferential velocity of the shroud 9 to half the value of the circumferential velocity of the shroud 9, as shown by a broken line H in FIG. 5.

In contrast to this, the present embodiment is such that the ribs 25 rotate at a velocity equal to the circumferential velocity of the shroud 9 along with the rotation of the rotating shaft 3. The ribs 25 consequently operate to increase kinetic energy in the rotational direction with respect to the leakage flow B. As a result, the rotational-direction velocity V of the leakage flow B reduces from the value approximately equal to the circumferential velocity of the shroud 9 to only a value greater than the value half of the circumferential velocity of the shroud 9, as shown by a solid line I in FIG. 5. In other words, the deceleration amount of the rotational-direction velocity V of the leakage flow B when the leakage flow B passes through the sealing device 20 is more reduced than when the leakage flow B passes through the conventional labyrinth seal. The ribs 25 function as deceleration controlling members to control a reduction in the rotational-direction velocity V of the leakage flow in the chamber 30.

As described above, the present embodiment reduces the deceleration amount of the rotational-direction velocity V of the leakage flow B when the leakage flow B passes through the sealing device 20 more than the conventional labyrinth seal. The present embodiment, therefore, reduces the fluid force that increases in accordance with the deceleration amount of the rotational-direction velocity V, compared with the conventional labyrinth seal. As a result, the unstable vibrations of the rotating shaft 3 can be suppressed more effectively than in the conventional labyrinth seal.

As shown by the solid line I in FIG. 5, the rotational-direction velocity V of the leakage flow B in the chamber 30 is lower in the downstream than in the upstream. Imparting kinetic energy to the leakage flow B having the less reduced rotational-direction velocity V, that is, the leakage flow B in the upstream to control the deceleration can more effectively control the final deceleration amount of the rotational-direction velocity V than imparting kinetic energy to the leakage flow B having the more reduced rotational-velocity V, that is, the leakage flow B in the downstream. The ribs 25, provided on the sealing fins 24 in the downstream of the leakage flow B in the present embodiment, control the deceleration of the leakage flow having the less reduced rotational-direction velocity V. The ribs 25 thus effectively control the deceleration amount of the rotational-direction velocity V. The present embodiment effectively controls the fluid force that increases in accordance with the deceleration amount of the rotational-direction velocity V, and thus suppresses the unstable vibrations of the rotating shaft 3.

The present embodiment provide the ribs 25 of the sealing device 20 between the respective sealing fins 24, thus eliminates the need for an additional space where the ribs 25 could be installed, and further eliminates the need to reduce the number of the sealing fins 24. The number of the sealing fins 24 can stay the same as the number of the conventional labyrinth seals. It is possible to prevent the increased amount of leakage resulting from the reduced number of the sealing fins 24.

As described above, the sealing device and turbo machine according to the first embodiment of the present invention provides the ribs (the deceleration controlling members) 25 between the respective sealing fins 24, the ribs rotating along with the rotation of the rotor 1. The rotation of the ribs consequently controls the reduction in the rotational-direction velocity V (the velocity of the rotational-direction flow C) of the leakage flow B. Thus, the unstable vibrations of the rotating shaft 3 of the steam turbine (the turbo machine) can be suppressed without reducing the number of the sealing fins 24.

The present embodiment provides the sealing fin 24 of each stage with the ribs 25, thus controls the reduction in the rotational-direction velocity V of the leakage flow B over the full length of the sealing device 20, and further reduces the final deceleration amount of the rotational-direction velocity V. As a result, the fluid force that increases in accordance with the deceleration amount of the rotational-direction velocity V is further reduced, which can effectively suppress the unstable vibrations of the rotating shaft 3.

Furthermore, the present embodiment provides a plurality of the ribs 25 in the circumferential direction of the sealing fins 24, and thus reliably controls the reduction in the rotational-direction velocity of the leakage flow B.

Modified Example of the First Embodiment

A modified example of the first embodiment of the sealing device and turbo machine of the present invention will be described with reference to FIGS. 5 and 6.

Figure 6:
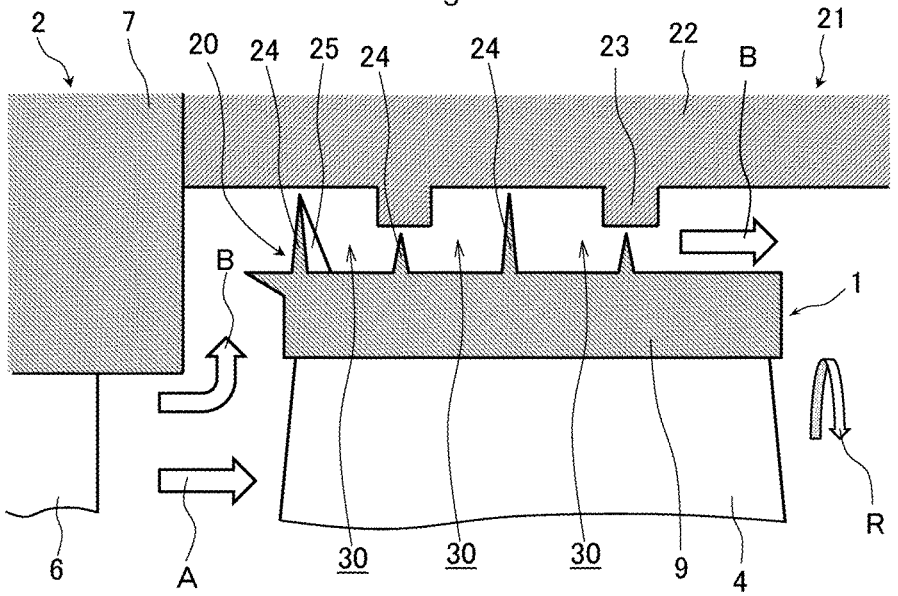
FIG. 6 is an enlarged longitudinal cross-sectional view illustrating a modified example of the sealing device and turbo machine according to the first embodiment of the present invention.

FIG. 6 is an enlarged longitudinal cross-sectional view of a modified example of the sealing device and turbo machine according to the first embodiment of the present invention. In FIG. 6, arrow A denotes the flow of main steam, arrow B denotes a leakage flow, and arrow R denotes the rotational direction of a rotating shaft. In FIG. 6, the same elements as used in FIGS. 1 to 5 are each assigned the same reference number and detailed description of these elements is therefore omitted herein.

The sealing device and turbo machine according to the modified example of the first embodiment of the present invention is such that the ribs 25 are provided only at the sealing fin 24 of the first stage, as shown in FIG. 2, while the first embodiment is such that the ribs 25 of the sealing device 20 are provided at the respective sealing fins 24 of the stages (see FIG. 2).

As shown in FIG. 5, a position at which the proportion of the deceleration amount of the rotational-direction velocity V of the leakage flow B is at the maximum is close to "x=0," that is, immediately after the passage of the sealing fin 24 of the first stage located at the furthest upstream of the leakage flow B. Since, as shown in FIG. 6, the ribs 25 are provided on a surface of the sealing fin 24 of the first stage in the downstream of the leakage flow B, the deceleration amount of the rotational-direction velocity V can effectively be reduced. The fluid force that increases in accordance with the deceleration amount of the rotational-direction velocity V can effectively be reduced.

As described above, the sealing device and turbo machine according to the modified example of the first embodiment of the present invention can suppress unstable vibrations of the rotating shaft 3 without reducing the number of the sealing fins 24, similar to the first embodiment.

Compared with the first embodiment, the present modified embodiment of the first embodiment has a smaller processing area where the ribs 25 could be installed. The present modified example can achieve a reduction in man-hour and machining time.

Second Embodiment

Figure 7:
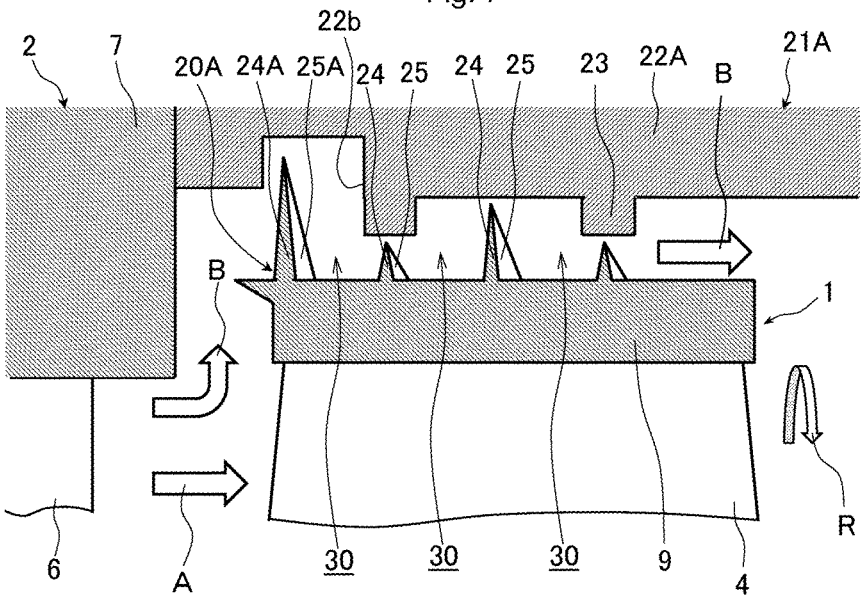
FIG. 7 is an enlarged longitudinal cross-sectional view illustrating a sealing device and turbo machine according to a second embodiment of the present invention.

A description is given of a sealing device and turbo machine according to a second embodiment of the present invention with reference to FIG. 7.

FIG. 7 is an enlarged longitudinal cross-sectional view of the sealing device and turbo machine according to the second embodiment of the present invention. In FIG. 7, arrow A denotes the flow of main steam, arrow B denotes a leakage flow, and arrow R denotes the rotational direction of the rotating shaft. In FIG. 7, the same elements as used in FIGS. 1 to 6 are each assigned the same reference number and detailed description of these elements is therefore omitted herein.

The first embodiment is such that the sealing fin 24 of the first stage of the sealing device 20 is configured to have a height roughly equal to that of the sealing fin 24 of the third stage. On the other hand, the sealing device and turbo machine according to the second embodiment of the present embodiment shown in FIG. 7 is configured such that a sealing fin 24A of a first stage of a sealing device 20A is higher than the sealing fins 24 of the other stages.

Specifically, as shown in FIG. 7, an annular groove 22*b* is provided at part of a main body 22A of a sealing ring 21A, the annular groove 22*b* facing the sealing fin 24A of the first stage. The sealing fin 24A of the first stage is configured to be higher than the sealing fins 24 of the other stages so that the tip portion of the sealing fin 24A of the first stage enters the inside of the annular groove 22*b* of the sealing ring 21A. In addition, the tip portion of the sealing fin 24A in the radial direction of the rotating shaft 3 is located outside of the sealing fins 24 of the other stages. Ribs 25A are provided on a surface of the sealing fin 24A of the first stage in the downstream of the leakage flow B. Each of the ribs 25A has a height roughly equal to that of the sealing fin 24A of the first stage. The heights of the sealing fins 24, 24A are set so that the clearance between the sealing fin 24A of the first stage and the bottom portion of the annular groove 22*b*, the clearance between the sealing fins 24 of the second and fourth stages and the protrusions 23, and the clearance between the sealing fin 24 of the third stage and the inner circumferential surface of the main body 22A of the sealing ring 21A are roughly equal to one another.

As described above, the sealing device and turbo machine according to the second embodiment of the present invention can produce the same advantageous effects as those of the first embodiment described earlier.

The present embodiment is such that the ribs 25A provided on the sealing fin 24A of the first stage are configured to be higher than the ribs 25 of the other stages. The area of each rib 25A that imparts kinetic energy in the rotational direction to the leakage flow B is greater than the area of each rib 25 of the other stages, because of the difference in height of the ribs 25A and ribs 25. Consequently, the deceleration amount of the leakage flow B after the passage of the sealing fin 24A of the first stage at which the proportion of the deceleration amount is at the maximum can further be reduced. The fluid force that increases in accordance with the deceleration amount of the leakage flow B is effectively reduced. Thus, the unstable vibrations of the rotating shaft can be effectively suppressed.

Further, the present embodiment is configured such that the tip portions of the ribs 25A provided on the sealing fin 24A of the first stage are located outside of the other ribs 25 in the radial direction of the rotating shaft 3. The outside portions of the ribs 25A are higher in circumferential velocity than the other ribs 25. Kinetic energy in the rotational direction imparted to the leakage flow B becomes greater according to the increased circumferential velocity. Consequently, the deceleration amount of the leakage flow B after the passage of the sealing fin 24A at which the proportion of the deceleration amount is at the maximum can further be reduced. The present embodiment, therefore, effectively reduces the fluid force that increases in accordance with the deceleration amount of the leakage flow B, and effectively suppresses the unstable vibrations of the rotating shaft 3.

Third Embodiment

Figure 8:
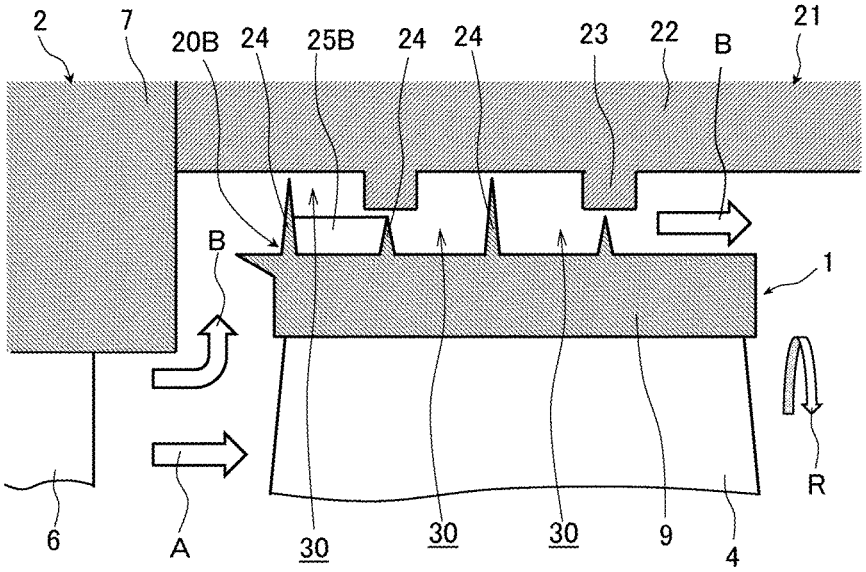
FIG. 8 is an enlarged longitudinal cross-sectional view illustrating a sealing device and turbo machine according to a third embodiment of the present invention.

A description is given of a sealing device and turbo machine according to a third embodiment of the present invention with reference to FIG. 8.

FIG. 8 is an enlarged longitudinal cross-sectional view of the sealing device and turbo machine according to the third embodiment of the present invention. In FIG. 8, arrow A denotes the flow of main steam, arrow B denotes a leakage flow, and arrow R denotes the rotational direction of the rotating shaft. In FIG. 8, the same elements as used in FIGS. 1 to 7 are each assigned the same reference number and detailed description of these elements is therefore omitted herein.

The modified example of the first embodiment is such that the ribs 25 of the sealing device 20 are provided so as to project from the sealing fin 24 of the first stage toward the downstream of the leakage flow B. On the other hand, the sealing device and turbo machine according to the third embodiment of the present invention is such that ribs 25B of a sealing device 20B are provided to extend between the sealing fin 24 of the first stage and the sealing fin 24 of the second stage. Specifically, the ribs 25B are provided to be connected with a surface of the sealing fin 24 of the first stage in the downstream of the leakage flow B and a surface of the sealing fin 24 of the second stage in the upstream of the leakage flow B.

The sealing device and turbo machine according to the third embodiment of the present invention described above can produce the same advantageous effects as those of the first embodiment described earlier.

The present embodiment is such that the ribs 25B are provided to extend between the sealing fin 24 of the first stage and the sealing fin 24 of the second stage. The area of each of the ribs 25B imparting kinetic energy in the rotational direction to the leakage flow B is increased, compared with the modified example of the first embodiment. Thus, the deceleration amount of the rotational-direction velocity V of the leakage flow B is further reduced. In particular, the deceleration amount of the leakage flow B after the passage of the sealing fin 24 of the first stage at which the proportion of the deceleration amount is at the maximum is further reduced. The present embodiment, therefore, effectively reduces the fluid force that increases in accordance with the deceleration amount of the rotational-direction velocity V, and effectively suppresses the unstable vibrations of the rotating shaft 3.

Fourth Embodiment

Figure 9:
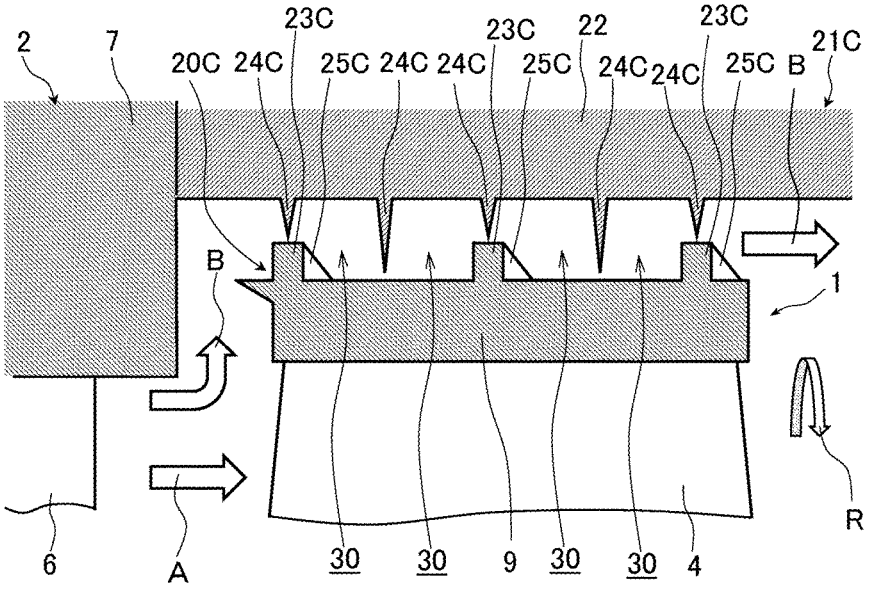
FIG. 9 is an enlarged longitudinal cross-sectional view illustrating a sealing device and turbo machine according to a fourth embodiment of the present invention.

A description is given of a sealing device and turbo machine according to a fourth embodiment of the present invention with reference to FIG. 9.

FIG. 9 is an enlarged longitudinal cross-sectional view of the sealing device and turbo machine according to the fourth embodiment of the present invention. In FIG. 9, arrow A denotes the flow of main steam, arrow B denotes a leakage flow, and arrow R denotes the rotational direction of the rotating shaft. In FIG. 9, the same elements as used in FIGS. 1 to 8 are each assigned the same reference number and detailed description of these elements is therefore omitted herein.

The sealing device 20 of the first embodiment is such that the sealing fins 24 are provided on the rotor 1 and the protrusions 23 are provided on the stator 2. On the other hand, the sealing device and turbo machine according to the fourth embodiment of the present invention is such that sealing fins 24C are provided on the stator 2 and protrusions 23 are provided on the rotor 1.

Specifically, as shown in FIG. 9, the sealing device 20C has the protrusions 23C that project radially outwardly of the rotating shaft 3 from the outer circumferential surface of the shroud 9. The protrusions 23C circumferentially extend on the outer circumferential surface of the shroud 9 and are of a circular shape. In addition, a plurality of stages (three stages in FIG. 9) of the protrusions 23C are provided in the axial direction of the shroud 9. Among the plurality of stages of protrusions 23C, a protrusion 23C of a first stage located at the furthest upstream of the leakage flow B is disposed at a leading end portion in the axial upstream of the shroud 9.

A sealing ring 21C of the sealing device 20C incorporates the main body 22 and sealing fins 24C. The main body 22 is attached to the nozzle diaphragm outer ring 7. The sealing fins 24C project radially inwardly of the rotating shaft 3 from the inner circumferential surface of the main body 22. The sealing fins 24C circumferentially extend on the inner circumferential surface of the main body 22 and are of a circular shape. A plurality of stages (five stages in FIG. 9) of the sealing fins 24C are provided in the axial direction of the main body 22. Among the plurality of stages of sealing fins 24C, sealing fins 24C of some stages, including the first stage, are provided to face the corresponding protrusions 23C. The sealing fins 24C are changed in length so that clearances between the tip portions of the sealing fins 24C and the shroud 9 or the corresponding protrusions 23C are equal to one another.

The sealing device 20C has ribs 25C, which are provided on the shroud 9 and the corresponding protrusions 23C so as to project into corresponding chambers 30 defined between the protrusions and the sealing fins 24C. The ribs 25C are provided to project from the protrusion 23C of each stage toward the downstream of the leakage flow B in the axial direction of the rotating shaft 3. Each of the ribs 25C extends in the height direction of the protrusion 23C and is formed like a triangle as viewed in the circumferential direction of the rotating shaft 3. Further, a plurality of the ribs 25C are arranged at intervals in the circumferential direction of the protrusions 23C.

In the present embodiment, the sealing fins 24C may be provided on the stator 2 (the nozzle diaphragm outer ring 7). However, disposing the ribs (the deceleration controlling members) 25C on the protrusions 23C provided on the rotor 1 (the shroud 9) will make the ribs 25C rotate along with the rotation of the rotor 1. The present embodiment, therefore, controls the reduction in the rotational-direction velocity V of the leakage flow B. Thus, similar to the case where the sealing fins 24 are provided on the rotor 1, the unstable vibrations of the rotating shaft 3 can be suppressed without reducing the number of the sealing fins 24.

That is to say, the turbo machine according to the fourth embodiment of the present invention described above can produce the same advantageous effects as those of the first embodiment described earlier.

OTHER EMBODIMENTS

The first to fourth embodiments described above illustrate the examples in which the sealing devices 20, 20A, 20B, 20C are used as the tip fin 12 that prevent the leakage of steam from the clearance passage G2 between the rotor blades 4 and the casing 5. However, the unstable vibrations of the rotating shaft 3 may be more affected by the fluid force caused by the pressure gradient, depending on the deceleration amount of the rotational-direction velocity V of the leakage flow B, than by the fluid force caused by the pressure distribution P uneven in the circumferential direction of the rotating shaft in the chamber 30. In such a case, the sealing devices can also be used as the diaphragm packing 11, the shaft packing 13, or other devices.

Additionally, the above-described embodiments illustrate the examples in which the shapes of the ribs 25 25A, 25B, 25C are triangles as viewed in the circumferential direction of the rotational shaft 3. However, the ribs may have shapes such as a square or a semicircle as well. In other words, the ribs only need to have such a shape as to control the reduction in the rotational-direction velocity V of the leakage flow B. Alternatively, a plurality of the ribs may have shapes and sizes different from each other.

Figure 10:
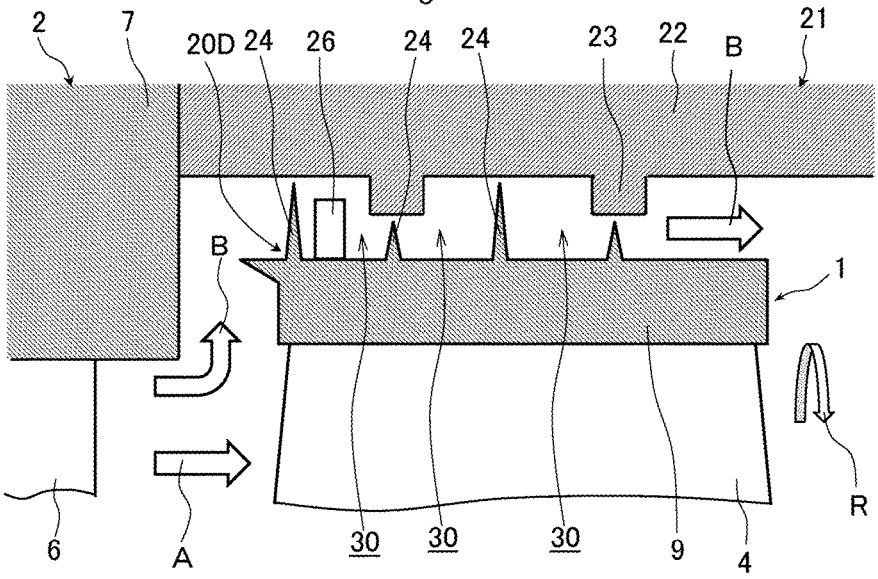
FIG. 10 is an enlarged longitudinal cross-sectional view illustrating a sealing device and turbo machine according to another embodiment of the present invention.

The above-described embodiments illustrate the examples in which the deceleration controlling members are the ribs 25, 25A, 25B, 25C that project from the sealing fins 24, 24A or the protrusions 23C toward the downstream of the leakage flow B. The deceleration controlling members need only to be ones that are provided on a rotational side such as the rotor 1 and parts rotating along with the rotor 1 so as to project into the chambers 30 defined between the sealing fins and that rotate together with the rotor 1 to control the reduction in the rotational velocity of the leakage flow B. For example, as shown in FIG. 10 the deceleration controlling member of a sealing device 20D may be a flat or curved plate member 26, provided on the shroud 9 in the axial direction of the rotating shaft 3, at any position between the sealing fins 24 of the first and second stages. Also in this case, the plate member 26 can control the reduction in the rotational velocity of the leakage flow B, thus suppressing the unstable vibrations of the rotating shaft 3, similar to the embodiments described above. It should be noted the plate member can be provided in each of the chambers 30 defined between a plurality of the sealing fins 24. FIG. 10 is an enlarged longitudinal cross-sectional view of a sealing device and turbo machine according to another embodiment of the present invention. In FIG. 10, arrow A denotes the flow of main steam, arrow B denotes the leakage flow, and arrow R denotes the rotational direction of the rotating shaft. In FIG. 10, the same elements as used in FIGS. 1 to 9 are each assigned the same reference number and detailed description of these elements is therefore omitted herein.

The above-described embodiments illustrate the sealing devices 20, 20A, 20B, 20C, 20D having sealing rings 21, 21A, 21C as examples. However, the sealing device can be configured such that the protrusions or the sealing fins are directly provided on the stator 2 (the nozzle diaphragm outer ring 7) without the sealing ring.

The above-described embodiments illustrate sealing devices 20, 20A, 20B, 20C, 20D in which the sealing fins 24, 24A, 24C provided on the rotor 1 or the stator 2 are combined with the protrusions 23, 23C provided on the stator 2 or the rotor 1. The sealing devices, however, may have no protrusions and be configured such that only the sealing fins are provided on the rotor 1 or the stator 2. In this case, it is only required that, with no protrusions, the lengths of all the sealing fins be equal. Additionally, the sealing device may also be configured such that the sealing fins are provided on both of the rotor 1 and the stator 2. Similar to the embodiments described above, the deceleration controlling members of the sealing device are required to be provided on the rotational side. In such a case as well, the deceleration controlling members rotate along with the rotation of the rotor 1. The present invention, therefore, controls the reduction in the rotational-direction velocity of the leakage flow B, and thus suppresses the unstable vibrations of the rotating shaft 3.

The above-described embodiments illustrate the examples in which the ribs 25, 25A, 25B are arranged in the circumferential direction of the sealing fin 24, 24A or the ribs 25C are arranged in the circumferential direction of the protrusion 23C. However, the sealing devices may have one rib (one deceleration controlling member). Also in this case, the rib can control the reduction in the rotational velocity of the leakage flow B.

The present invention is not limited to the above embodiments and may embrace varieties of modifications. The embodiments have only been described in detail for a better understanding of the invention and are therefore not necessarily limited to the configurations containing all described constituent elements. For example, part of the configuration of a certain embodiment may be replaced by the configuration of another embodiment and the configuration of a certain embodiment may be added to the configuration of another embodiment. Furthermore, part of the configuration of one of the embodiments may be added to, deleted from, and/or replaced by the other embodiments.

What is claimed is:

1. A sealing device for a turbo machine including a rotor having a rotating shaft and a stator enclosing the rotor, the sealing device controlling a leakage flow from a clearance passage defined between the rotor and the stator, the sealing device comprising:

a plurality of sealing fins disposed at least on the rotor, the plurality of sealing fins being arranged in an axial direction of the rotor; and at least one deceleration controlling member provided on a rotational side, the at least one deceleration controlling member projecting toward a chamber defined between the sealing fins, the at least one deceleration controlling member being configured to reduce a deceleration amount of the velocity of the leakage flow in the chamber in a rotational direction of the rotor, wherein the at least one deceleration controlling member is a rib that projects from a certain sealing fin of the plurality of sealing fins toward a downstream of the leakage flow in the axial direction of the rotor, the rib being spaced away from a sealing fin of the plurality of sealing fins adjacent to and downstream of the certain sealing fin, the rib being formed in a triangular shape as viewed in a circumferential direction of the rotor.

2. The sealing device according to claim 1, wherein, among the plurality of sealing fins, a sealing fin of a first stage located on a furthest upstream of the leakage flow is higher than other sealing fins of other stages, and the rib is provided on the sealing fin of the first stage, the rib being as high as the sealing fin of the first stage.

3. The sealing device according to claim 1, wherein the at least one deceleration controlling member comprises a plurality of deceleration controlling members, the plurality of deceleration controlling members being disposed in each of the chambers defined between the plurality of sealing fins.

4. The sealing device according to claim 1, wherein the at least one deceleration controlling member is disposed only in a chamber defined between a sealing fin of a first stage located on a furthest upstream of the leakage flow and a sealing fin of a second stage adjacent to the sealing fin of the first stage, and no deceleration controlling member is disposed in other chambers between sealing fins except for the sealing fins of the first stage and the second stage.

5. The sealing device according to claim 1, wherein the at least one deceleration controlling member comprises a plurality of deceleration controlling members, the plurality of deceleration controlling members being arranged in the circumferential direction of the rotating shaft.

6. A turbo machine comprising the sealing device according to claim 1.

7. A sealing device for a turbo machine including a rotor having a rotating shaft and a stator enclosing the rotor, the sealing device controlling a leakage flow from a clearance passage defined between the rotor and the stator, the sealing device comprising:

a plurality of sealing fins disposed at least on the stator, the plurality of sealing fins being arranged in an axial direction of the rotor; and at least one deceleration controlling member provided on a rotational side, the at least one deceleration controlling member projecting toward a chamber defined between the sealing fins, the at least one deceleration controlling member being configured to reduce a deceleration amount of the velocity of the leakage flow in the chamber in a rotational direction of the rotor, wherein the sealing device further includes a plurality of protrusions that project from the rotor, the plurality of protrusions each facing the sealing fins, and the at least one deceleration controlling member is a rib that projects from a certain protrusion of the plurality of protrusions toward a downstream of the leakage flow in the axial direction of the rotor, the rib being spaced away from a protrusion of the plurality of protrusions adjacent to and downstream of the certain protrusion, the rib being formed in a triangular shape as viewed in a circumferential direction of the rotor.

8. The sealing device according to claim 7, wherein the at least one deceleration controlling member comprises a plurality of deceleration controlling members, the plurality of deceleration controlling members being disposed in each of the chambers defined between the plurality of sealing fins.

9. The sealing device according to claim 7, wherein the at least one deceleration controlling member comprises a plurality of deceleration controlling members, the plurality of deceleration controlling members being arranged in the circumferential direction of the rotating shaft.

10. A turbo machine comprising the sealing device according to claim 7.

* * * * *